United States Patent [19]

Hackman

[11] Patent Number: 4,903,751

[45] Date of Patent: Feb. 27, 1990

[54] TWO WHEEL MELT OVERFLOW PROCESS AND APPARATUS

[75] Inventor: Lloyd E. Hackman, Worthington, Ohio

[73] Assignee: Ribbon Technology Corporation, Gahanna, Ohio

[21] Appl. No.: 267,260

[22] Filed: Nov. 4, 1988

[51] Int. Cl.[4] ..... B22D 11/06

[52] U.S. Cl. ..... 164/480; 164/423; 164/428; 164/463

[58] Field of Search ..... 164/480, 463, 428, 423

[56] References Cited

U.S. PATENT DOCUMENTS 4,771,819 9/1988 Toyama et al. ..... 164/428

FOREIGN PATENT DOCUMENTS 0147912 7/1985 European Pat. Off. ..... 164/423
58-41656 3/1983 Japan ..... 164/428
58-41657 3/1983 Japan ..... 164/428
59-97743 6/1984 Japan ..... 164/480
59-118246 7/1984 Japan ..... 164/428
61-38740 2/1986 Japan ..... 164/423

*Primary Examiner*—Nicholas P. Godici
*Assistant Examiner*—J. Reed Batten, Jr.
*Attorney, Agent, or Firm*—Frank H. Foster

[57] ABSTRACT

A method for the production of a unitary or laminated film or sheet of finely controlled thickness from a molten material utilizes spaced, first and second parallel rolls rotating in opposite directions to form a kissing zone between the rolls. The method moves the surface of a cooling rotating roll past a region of contact with a molten material to form a rapidly solidifying layer of material thereon, which then is passed into the kissing zone, wherein the solidified layer is either pressed to form a unitary film or is fused by contacting another solidified layer.

16 Claims, 2 Drawing Sheets

TWO WHEEL MELT OVERFLOW PROCESS AND APPARATUS

TECHNICAL FIELD

This invention relates to a process and accompanying apparatus for producing film or sheet of finely controlled thickness and microstructure, and more particularly relates to a process and apparatus for producing a wide variety of such materials directly from a molten material, such as metals, polymers and ceramics. The process initially moves the surface of a cooling, rotating roll past a region of contact with the molten material to form a rapidly solidifying layer of the material thereon, then cools the layer and passes it into a kissing region where it contacts a second, oppositely rotating upper roll which may contain a chilled, solidifying layer. The resultant pressing forms a unitary or fused product film or sheet which is removed from the apparatus.

BACKGROUND ART

The prior art discloses a variety of methods and apparatus which can produce solid material directly from a source of molten material. Many of these prior art systems are for the fabrication of metal products and use some type of fixed, rigid, noncontrollable forming orifice to stabilize the dimensions of the product. Additionally, the prior art utilizes a wide variety of two wheel systems that form a kissing zone as they rotate in opposite directions.

With respect to two wheel systems which form a finished product, the Bessemer U.S. Pat. No. 49,053, discloses the basic, concept behind a majority of the systems that are currently utilized. Bessemer manufactures sheets, plates and the like directly from fluid malleable iron or steel by utilizing a pair of rolls, with their axes in a horizontal, parallel position to form a kissing zone. The molten metal is poured into this kissing zone, or thin space between the rolls, which are constantly moving during the flow of the metal between them. The cool surfaces of the rolls rapidly solidify the metal and the pressure of the rolls forms a metal product. However, as one would expect from such an early setup, there are many difficulties present in the system of Bessemer, particularly with respect to their utilization of a fixed sized crucible.

U.S. Pat. No. 1,756,196 to Hopkins, et al. discloses a method of making metal sheets wherein the method teaches solidifying on a first roll and then rolling with a second roll to produce a finished product.

U.S. Pat. No. 2,171,132 to Simons discloses a process of producing film products from molten materials in which a pair of relatively cool, rotating cylindrical members each have a portion of their surface submerged in the heated material. A suction process is utilized to suck the molten material in between the grooves on the wheel's outer surfaces.

U.S. Pat. No. 993,904 to Strange discloses a forerunner of a melt overflow system which is related to that used in the invention.

U.S. Pat. No. 4,224,978 to Klein discloses forming a metal strip product in a continuous casting process featuring two rolls and a kissing zone in which aluminum is discharged between the rolls by means of a nozzle having a particular structure; the process and apparatus are substantially different than those of the present invention.

U.S. Pat. No. 4,274,471 to Minoura, et al. discloses a process for the continuous casting of metals into sheets, wires, bars and the like. The process comprises a roll system with the main roll cooled from an inner portion and a plurality of sub-rolls, the sub-rolls being provided along the outer periphery surface of the main roll by holding a given gap against the main roll, supplying a molten metal into the gap formed by the main roll and the sub-rolls while rotating the main roll and the sub-rolls mutually in a direction carrying with the molten metal, allowing the molten metal to solidify when the molten metal passes through the gap between the main roll and the sub-rolls and taking out the solidified metal continuously from the roll system.

U.S. Pat. No. 4,518,029 to Shibuya, et al. discloses a double roll type method and apparatus for producing a thin metallic sheet by pouring a molten metal of a desired composition into a kissing region between two cooling rolls rotating in opposite directions, and rapidly cooling and solidifying the molten metal while it passes through the kissing region.

U.S. Pat. No. 4,705,905 discloses a textured surface which is suitable for usage as a cooling roll.

In page 45, FIG. 3 of the article, "Latest Developments and Operating Results of the High Speed Strip Coating Machine at SMS Schloemann-Siemag AG, W. Germany" by Friedrich-Marten et al., a two wheel strip caster is set forth.

It is known to utilize resiliently mounted springs on rotating wheels to control the resulting pressure exerted onto a sheet or film.

Accordingly, it is an object of the present invention to provide a process and accompanying apparatus which can produce a uniform, high quality film or sheet product of carefully controlled thinness, smoothness and microstructure by freezing material on one or both rolls followed by pressing the rolls to form either a unitary or a fused product.

It is another object of the invention to make a wide variety of film and sheet products by utilizing a single, flexible process and accompanying apparatus setup which can monitor the roll pressure in a roll kissing zone, be free of the problems involving metal orifices, have excellent control of the frozen film thickness and microstructure and be suitable for the utilization of textured rolls to make a product of desired characteristics.

Upon further study of the specification and appended claims, further objects and advantages of this invention will become apparent to those skilled in the art.

SUMMARY OF INVENTION

In a method aspect, this invention relates to a method for the production of a film or sheet of finely controlled thickness and microstructure from a molten material which utilizes spaced, first and second parallel rolls rotating in opposite directions to form a kissing zone between the rolls, the method comprising; contacting a molten film of predetermined thickness overflowing from a molten material receptacle onto the first roll and cooling thereon to form an at least partially solidified first film, the first roll rotating around a lower circumferential axis than the second roll; positioning the second roll either (1) completely above the molten material and the receptacle or (2) partially immersed therein, the partially immersed second roll forming and cooling a second, at least partially solidified film thereon; pressing the first film on the first roll with either (1) the second roll surface or (2) the second film on the second roll, in the kissing zone to form a substantially solidified film product; removing the solidified film product.

In an apparatus aspect, the invention relates to an apparatus for producing a film or sheet of finely controlled thickness and microstructure from a molten material, the apparatus comprising: (a) a receptacle for containing a pool of molten material, the receptacle including a wall portion having an upper generally horizontal edge relatively lower than the top of said receptacle and over which molten material may be overflowed; (b) a movably mounted, heat extracting, generally cylindrical first roll spaced a fixed distance from the edge so as to be contacted by the overflowing molten material at the level of the upper surface of the molten material; (c) a movably mounted, generally cylindrical second roll adaptable for rotating in the opposite direction to the first roll along an axis parallel thereto but positioned above the axis of the first roll, whereby the distance between the outer surfaces of the first and second rolls form a kissing zone and at least one roll has means for controlling the applied pressure to a film or sheet within the kissing zone; (d) means for rotating the first and second rolls in opposite direction at substantially the same surface speed to each other.

BRIEF DESCRIPTION OF DRAWINGS

FIG. 7 describes a roll suitable for molten material contacting that contains a plurality of patterns on the outer contacting surface.

Figure 1:
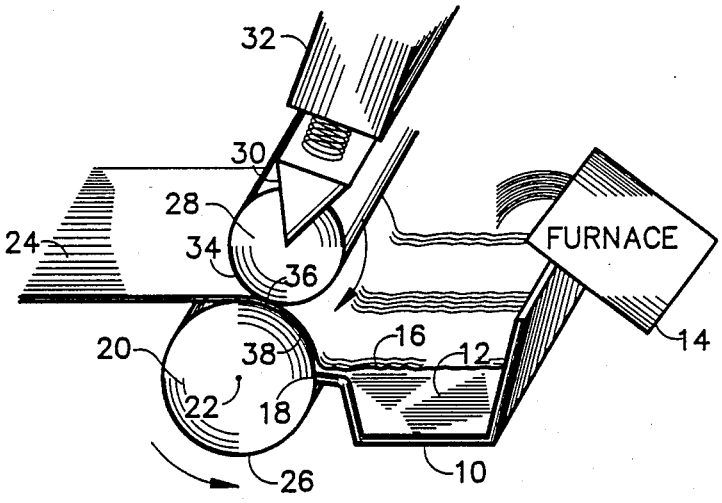
FIGS. 1–3 are simplified diagrams of three respective embodiments of the invention, each having a different position of the upper rotating roll in relationship to the surface of the molten material present in the tundish.

In describing the preferred embodiment which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a receptacle, or tundish 10 which is heated in a conventional manner and contains a pool of molten material 12 which can be supplied by a variety of methods, such as from furnace 14. However, instead of the walls of receptacle 10 everywhere extending above the upper surface 16 of the molten material 12, a portion of the receptacle wall is absent in the region above a generally horizontal edge 18 which is formed at the top of a portion of the wall of the receptacle 10. A particularly suitable receptacle for depositing thin, molten substrates on rotating surfaces and the like is set forth in copending application Ser. No. 89,544 filed Aug. 26, 1987 and now U.S. Pat. No. 4,831,472, the disclosure of which is incorporated by reference.

Edge 18 is lower than the top of the other walls of the receptacle so that the molten material level may be raised sufficiently to overflow over the edge 18 and onto a peripheral surface of a lower cylindrical heat extracting substrate, i.e., a rotating wheel or roll 20 which is rotated about its pivot axis 22. The cooling roll 20 is spaced a fixed distance from the edge 18 and is preferably vertically and horizontally adjustable relative to the edge during periods of non apparatus operation so as to permit the spacing from the edge to be controllably varied and also to permit adjustment of the angular position about the roll 20 at which the molten material melt or film 24 contacts the surface 26 of roll 20.

A conventional means such as an electrical motor and connecting drive means (both not shown) are provided for driving the surface 26 of the roll 20 past the region of its contact with the melt 16. In most applications it is driven at a surface speed in the range of 0.1 to 5.0 meters/sec.

Above the first roll 20 is positioned a second rotating substrate, i.e., roll 28, the respective axes of rotation of the rolls being parallel while their rotational motion is in opposite direction. Upper roll 28 is attached to a resilient spring means 30 positioned on an immovable substrate 32. This enables the resulting pressure in the "kissing zone", i.e. the area wherein the two roll surfaces 26 and 34 are positioned nearest to one another and through which the molten and partially solidified film or films which must be pressed to form a product film or sheet pass through, to be carefully maintained within a predetermined range.

Although not essential, it is greatly preferred to have the upper roll spring pressure controlled and a hydraulic system or the like can also be used in place of a spring system. In the embodiment set forth in FIG. 1, upper roll surface 34 does not come in contact with a molten metal chilled film or melt frozen on the lower roll 20 until the melt enters into kissing region 36, wherein the upper roll presses the melt with a desired controlled pressure to produce a smooth, high quality film product of desired thickness, smoothness and microstructure. Additionally, roll 20 is cooled in a manner known to one skilled in the art.

By utilization of a resilient spring mount on upper roll 28, the kissing pressure is controlled so the process can produce a smooth, consistent, high quality and, if desired, very thin film product. The films and fibers produced can be very thin, in part because melt overflow technology permits very thin, high quality products to be formed.

Figure 2:
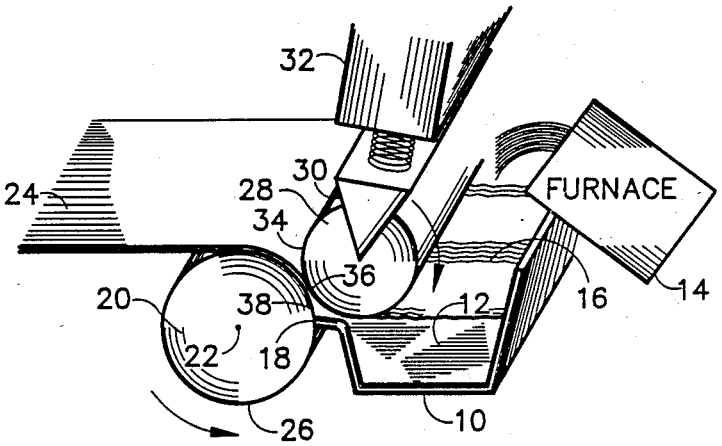
Figure 3:
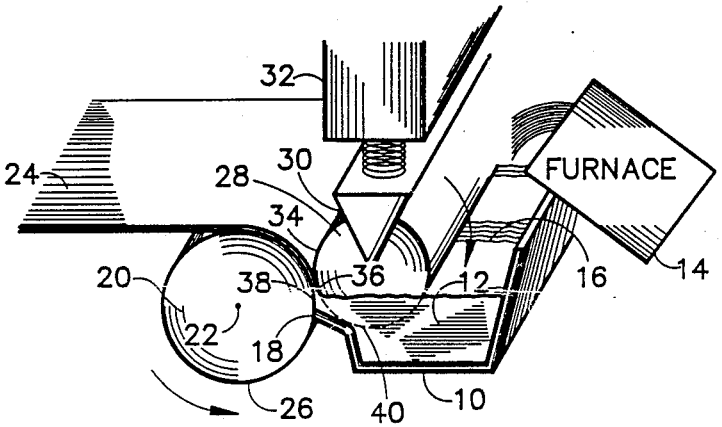

As can be seen in FIGS. 2 and 3 an advantage of the invention is that small variations in the basic apparatus setup enable a wide variety and great amount of flexibility in the types of products which can be produced. Both embodiments feature a repositioning of the upper roll 28 in relationship to the surface 16 of the bath of molten material. In FIG. 2, as well as FIGS. 1 and 3, the melt overflow system produces a thin melt film 38 which in this particular embodiment is deposited almost in the immediate kissing region 36 between wheels 20 and 28. Upper wheel 28 is positioned so that the upper wheel surface 34 almost touches the surface 16 of the molten material in the receptacle 10. FIG. 3 retains the basic geometrical relationship of the two rolls, i.e., the axis of the spring controlled roll is above the melt deposited cooling roll 20. However, roll 28 is now immersed in the pool of molten metal, thus both lower and upper rolls form films 38 and 40, respectively, of chilled material on their respective surfaces, which are pressed into a fused film 24. It should be noted that although upper roll 28 is cooled in FIG. 3 so as to produce a frozen film on its surface, in other embodiments, such as that of FIG. 1, the upper roll does not have to be chilled and thus functions as a cold forming roll. Thus, in the broadest embodiment, the invention can utilize either one or two cooling surfaces to form a variety of resultant products; it is preferred to utilize both wheels as chilling surfaces. Also, the precise degree of chilling on each wheel does not have to be constant, but can instead be varied so as to change the characteristics of the product to be formed.

As one skilled in the art can easily understand, the wide variety of apparatus embodiments which can be obtained from variations in the respective axial positions of the two rolls, the differing cooling rates and diameters each roll can have, and also the differing dimensions of the kissing zone can all be made by minor changes which enable the production of significantly different products. Thus this relatively simple system gives a great deal of flexibility regarding type of product formed in its operation. Also, certain embodiments of the invention enable the material to pass into the kissing region either in molten form, or as an at least partially frozen film with either one or both rolls being cooling agents.

Figure 4:
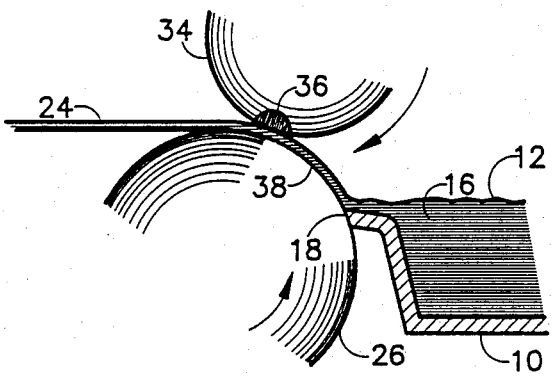
FIG. 4 is a close-up section of molten and frozen material flowing into the kissing zone between the two rolls.

In FIG. 4 is set forth a close-up of an embodiment similar to FIGS. 1 and 2, wherein it is seen that the melt overflow contacts the lower cooling substrate 26 to form a solid film 38; also, some molten material enters into the kissing region 36 wherein it is pressed to form a film product 24.

The particular dimensions of kissing region 36 must be carefully controlled in order to produce a desired product, as one skilled in the art will quickly realize. For example, unless the spacing in this region is just the sum of the thickness of the two solidified layers frozen on each roll, the resultant product film will feature centerline segregation. That is, e.g., if the rolls are too far apart, a molten material, i.e. liquid, will be present in between the two solidified films and the resulting section of the product will possess a different alloy composition than that exhibited by the solid compositions. Such a resulting product thus lacks the consistent homogeneity required in a product film, since it cannot form a fused film in which fusion zones that have a substantially homogeneous composition are found along the line where the two chilled segments fuse together.

Figure 5:
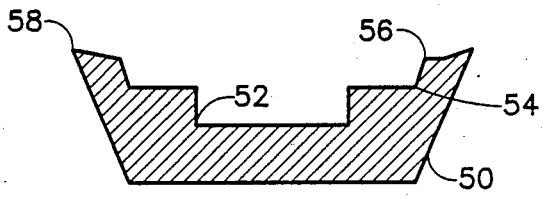
FIG. 5 sets forth a cross sectional view of a film product produced by at least partially freezing material on each roll surface and fusing the two films together.

FIG. 5 sets forth a simplified outline of a cross section of a product film formed from an operation such as seen in FIGS. 3 or 4. In these embodiments, the process forms at least partially chilled films on each roll surface and then fuses the two films together in the kissing zone to form the product 100. The cross sectional view indicates that in areas 102 and 104, which correspond to the completely chilled portions of the films formed on the upper and lower rolls, respectively, dendrites are seen to have formed. Thus, the product 100 exhibits a cross section in which rigid, solidified grain structures are found on both surfaces, while the middle section 106 lacks such a grain structure and instead is a fusion zone which exhibits a substantially homogeneous composition throughout. Also, the various thicknesses of sections 102, 104 and 106 can be carefully controlled by controlling the thickness of melt which is frozen and which is kept in molten form on each roll before fusion together in the kissing zone. Thus, as one skilled in the art can readily understand, the products formed by the process of the invention can be very carefully fabricated and their structure and properties very carefully controlled.

A particular advantage of melt overflow is the ability to very accurately control the depth of metal deposited or frozen on a substrate. This is because the molten metal is kept in a large receptacle whose height can be more easily and carefully controlled than can the smaller kissing zones associated with the Bessemer process, in which it is very difficult to constantly control the resulting height of metal in the kissing zone. Additionally, orifice containing systems have a similar problem maintaining constant flow through a small orifice, due to such problems as metal freezing. Thus, constant molten material flow is much more difficult to control than in the melt overflow system.

Figure 6:
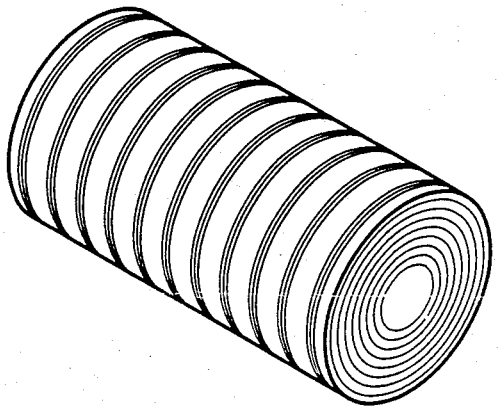
FIG. 6 is a cross sectional side view of a tundish illustrating the inner molten material containing structure.

FIG. 6 sets forth a cross section of a molten material containing receptacle, i.e. tundish, 50 particularly suitable for usage in the invention. One can see that by carefully forming volume variations inside the tundish with changing heights 52, 54 and 56 the amount of material overflowing the lower edge 58 can be carefully and easily controlled by the skilled operator.

FIG. 7 illustrates a surface containing patterns which may be ridges, contours, or the like and can be formed on either one or both of the roll surfaces used in the invention. It is preferred to so texture only the first or bottom roll, although the second roll can also be so constructed. The circular, concentric ridges are positioned around a cylinder and form a roll suitable for use in pressing and if desired, cooling the formed product. By utilizing such indentations in one or both of the rotating rolls a wide variety of products can be made. Also, the grooves enable films of greater thickness to be utilized in the fabricated products, which may be desirable in certain instances. In any event, one skilled in the art can utilize a wide variety of different ridge, grooves, helical structures and the like texturing to produce a desired product, in similar fashion as in Ser. No. 89,544.

The characteristics of the products produced by the invention is also influenced by other parameters as well as by the particular method of fabrication. For example, it is preferred to closely control the level in the molten material containing receptacle by utilization of a plunger, such as those which are known in the art. Also, the pressure head or hydrostatic pressure of the overflowed molten material is dependent upon the height of the surface of the molten material above the overflow edge. Other variables include the position of each rotating roll, as described earlier, the particular molten material utilized to form a product, and the like.

While certain preferred embodiments of the present invention have been disclosed in detail, it is to be understood that various modifications may be adopted without departing from the spirit of the invention or scope of the following claims.

I claim:

1. A method for the production of a film or sheet of finely controlled thickness and microstructure from a molten material which utilizes spaced, first and second parallel rolls rotating in opposite directions to form a kissing zone between the rolls, the method comprising:

contacting a molten material overflowing from the uppermost portion of a molten material receptacle onto the rotating first roll and cooling thereon to form an at least partially solidified first film of predetermined thickness, wherein the direction of rotation of said first roll is such that the partially solidified film is conveyed upward and away from the surface of the molten material and over the uppermost portion of said first roll;

rotating the second roll around a higher circumferential axis than the first roll, whereby the second roll does not contact the molten material in the molten material receptacle;

pressing the first film on the first roll with the second roll in the kissing zone to form a substantially solidified film product, whereby neither the first nor the second roll is immersed in the molten material;

removing the solidified film product.

2. A process according to claim 1 wherein the second roll applies a controlled kissing pressure adapted to substantially range within a predetermined value.

3. A process according to claim 1, further comprising positioning the second roll completely above the molten material, the second roll surface being substantially free of molten or solidified molten material as it approaches the kissing zone.

4. A process according to claim 1 wherein the kissing region between the cooling rolls is of a magnitude enabling the formed film product to have a fusion zone exhibiting a substantially homogeneous composition.

5. A process according to claim 1 wherein the film entering into the kissing zone is at least partially molten.

6. A process according to claim 1 wherein at least one of the first and second rolls utilizes a plurality of patterns on the roll surface which are simultaneously migrated laterally of the direction of movement to produce a desired, thicker film.

7. A process according to claim 6 wherein only the first roll utilizes a plurality of patterns to contact the film.

8. A process according to claim 1 wherein the surface speed of the rolls is about 0.1 to 15.0 meters/sec.

9. Apparatus for producing a film or sheet of finely controlled thickness and microstructure from a molten material, the apparatus comprising:

(a) a receptacle for containing a pool of molten material, the receptacle including a wall portion having an upper generally horizontal edge relatively lower than the top of said receptacle and over which molten material may be overflowed;

(b) a movably mounted, heat extracting, substantially cylindrical first roll spaced a fixed distance from the edge so as to be contacted by the overflowing molten material at the level of the upper surface of the molten material to form an at least partially solidified film, wherein the direction of rotation of said first roll is such that the partially solidified film is conveyed upward and away from the surface of the molten material and over the uppermost portion of said first roll;

(c) a movably mounted, generally cylindrical second roll adaptable for rotating in the opposite direction to the first roll along an axis parallel thereto but positioned above the axis of the first roll, whereby neither the first nor the second roll is immersed in the molten material and whereby the second roll does not contact the molten material, and whereby the distance between the outer surfaces of the first and second rolls form a kissing zone and at least one roll has a means for controlling the applied pressure to a film or sheet within the kissing zone; and (d) means for rotating the first and second roll in opposite rotation at substantially the same surface speed to each other.

10. Apparatus according to claim 9 wherein the first roll is vertically and horizontally adjustable relative to the edge during non operation.

11. Apparatus according to claim 9 wherein the second roll is vertically and horizontally adjustable to the upper surface of the molten material and/or the first roll.

12. Apparatus according to claim 9 wherein at least one of the first or second rolls features a plurality of protruding patterns.

13. Apparatus according to claim 9 wherein the receptacle for containing the pool of molten material further comprises a plunger adaptable for controlling the level of molten material therein and flowing over the edge.

14. Apparatus according to claim 9 wherein the controlled pressure in the kissing zone is regulated by a resilient spring mounted on the second roll.

15. Apparatus according to claim 9 wherein the first and second rolls are cooling rolls.

16. Apparatus according to claim 9 wherein the rolls rotate at about 0.1 to 15.0 meters/sec.

* * * * *